US006536863B1

(12) United States Patent
Beauchamp et al.

(10) Patent No.: US 6,536,863 B1
(45) Date of Patent: Mar. 25, 2003

(54) INKJET PRINT MOISTURE RE-CIRCULATION

(75) Inventors: Robert W. Beauchamp, Carlsbad, CA (US); Michael J. Klausbruckner, San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 10/066,112

(22) Filed: Jan. 31, 2002

(51) Int. Cl.[7] ..... B41J 2/165; B41J 29/377; B41F 23/00; B41F 23/04

(52) U.S. Cl. ..... 347/17; 347/18

(58) Field of Search ..... 347/102, 18, 17, 347/25; 101/487, 488, 424.1

(56) References Cited

FOREIGN PATENT DOCUMENTS

| | | | | |
|---|---|---|---|---|
| GB | 2353761 | * | 3/2001 | ..... B41F/23/00 |
| JP | 2000-255053 | * | 9/2000 | ..... B41J/2/165 |

* cited by examiner

*Primary Examiner*—Huan Tran
(74) *Attorney, Agent, or Firm*—Roth & Goldman

(57) ABSTRACT

A method of operating an inkjet printer comprises forming an image on a media sheet by ejecting ink from an orifice array of an inkjet printhead at a print zone, capturing moist atmosphere from said printed image at a moisture removal zone and conducting moist atmosphere to said orifice array. An inkjet printing mechanism is provided including means for removing moisture from a printed sheet of media and means for conducting moisture removed from said printed sheet to an inkjet orifice array at a print zone.

23 Claims, 1 Drawing Sheet

INKJET PRINT MOISTURE RE-CIRCULATION

BACKGROUND OF THE INVENTION

Inkjet printing produces wet images from which moisture may need to be removed to preserve image quality, particularly at higher printing speeds. Inkjet printers ordinarily include a printhead servicing station which typically includes printhead wipers, a source of printhead servicing fluid and printhead caps, some or all of which may be mounted on a sled or other moveable support to bring the service station into and out of operating proximity to the printheads to be serviced. Printhead servicing intervals should be minimized to correspondingly reduce printing downtime. The adverse results of frequent printhead servicing intervals are particularly acute in high throughput printing.

SUMMARY OF THE INVENTION

According to one aspect of the present invention, a method of operating an inkjet printer comprises forming an image on a media sheet by ejecting ink from an orifice array of an inkjet printhead at a print zone, capturing moist atmosphere from said printed image at a moisture removal zone and conducting moist atmosphere to said orifice array.

According to another aspect of the present invention, an inkjet printing mechanism is provided including means for removing moisture from a printed sheet of media and means for conducting moisture removed from said printed sheet to an inkjet orifice array at a print zone.

DETAILED DESCRIPTION OF THE PREFERRED EMBODIMENTS

Figure 1:
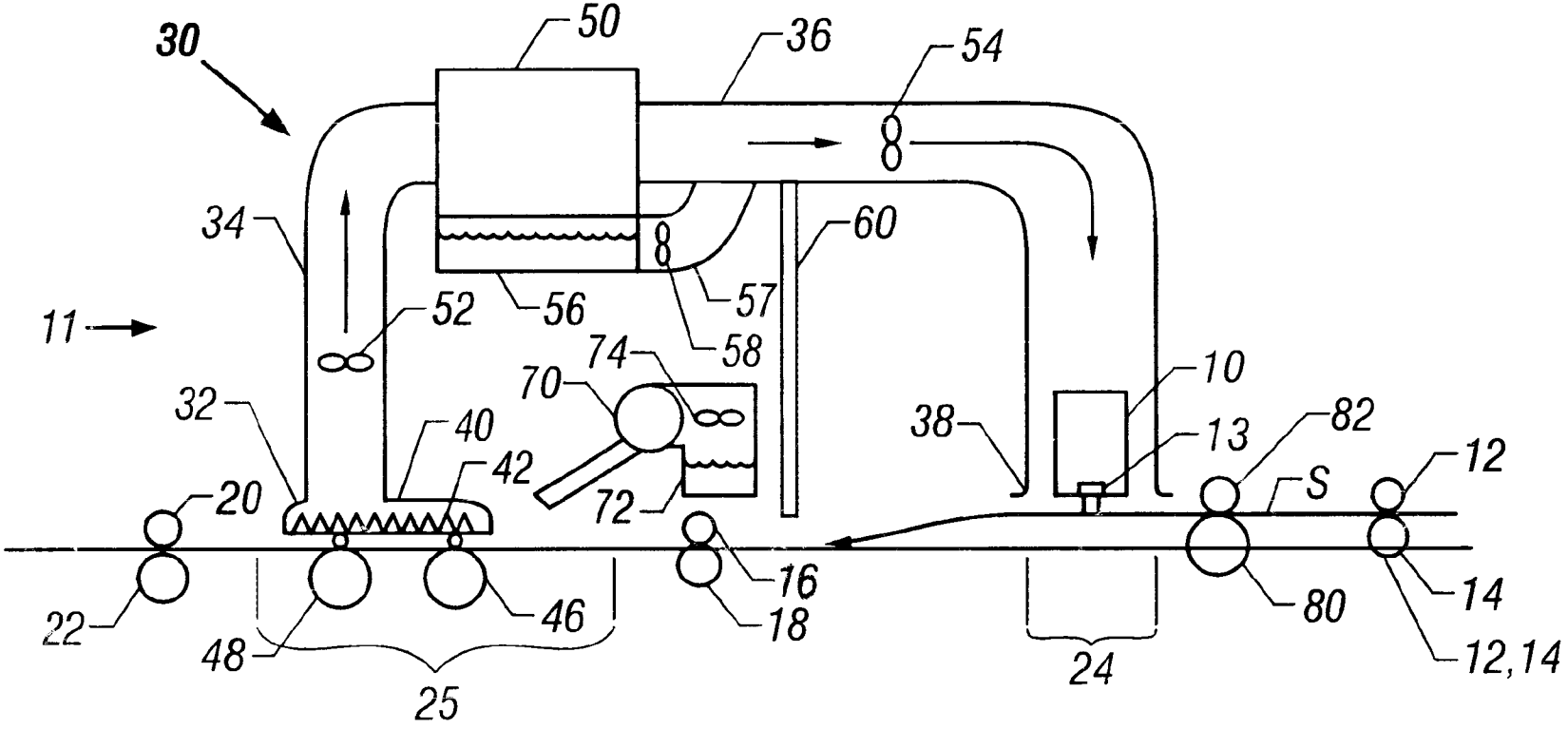
FIG. 1 is a schematic diagram illustrating a presently preferred embodiment of the present invention.

High speed printing of the order of 200 pages/minute or faster results in the necessity to rapidly remove moisture from the printed pages. High speed printers may include a number of stationary inkjet printheads or pens to avoid problems associated with acceleration and deceleration of scanning pen carriages. Although it is contemplated that the method and apparatus concepts illustrated herein will be primarily used in high speed stationary pen inkjet printers they can of course be used with scanning or other types of printers as well with reconfiguration as necessary for the particular implementation employed.

FIG. 1, comprising the sole figure of drawings, schematically shows a printhead 10 of an inkjet printing mechanism, illustrated as a high-speed printer 11. The printhead 10 is positioned to eject ink droplets from an array 13 comprising one or more microscopic orifices or nozzles onto a media sheet S which moves from right to left as shown in the drawing. The media can of course be in any suitable configuration including rollfeed media and individual cut sheets. Movement of the media sheet may be caused by opposed pairs of spaced sheet transport rollers 12, 14; 16, 18; and 20, 22 or by opposed driven belts or by any other functionally equivalent means. It will be further appreciated that, although the schematic figure shows a straight path of media movement, the path may be straight or curved depending on the environment and configuration of the printer. As shown, the media sheet moves through a print zone 24 and subsequently through a moisture removal zone 25 which, in the arrangement shown in the drawing, is physically spaced somewhat from the print zone 24. The spacing of the moisture removal zone 25 from the print zone 24 should not be considered limiting since printer configurations can be designed in which the print zone 24 and moisture removal zone 25 are juxtaposed.

The printer 11 has duct work 30, including a moisture removal hood 32 and duct sections 34 and 36 to collect moisture removed from a wet inkjet image on a printed media sheet. Duct section 36 terminates in an outlet 38 which, as shown, preferably generally surrounds the printhead 10 for conducting moisture removed from the media sheet to the area of the orifice array 13 of the inkjet printhead 10. It will be further appreciated that the outlet 38 of the duct section 36 need not surround the printhead and can be positioned at any suitable location relative to the orifice array 13 for keeping the orifices moist and preferably at desired temperature during printing.

The moisture removal zone 25 preferably includes a heater 40 which can comprise electrical resistance elements 42 for convection heating and/or heated rollers 46, 48 for conduction heating of the wet media sheets to dry the sheets and thus remove substantially all of the moisture content of the printed image and sheet itself through the duct work 30. Various alternative means of removing moisture will be apparent to those skilled in the art and may include heated or unheated blowers, and conductive or radiant heaters such as lamps, blanket heaters and other equivalents. Blower fans 52, 54 can be positioned at selective locations in the duct sections for removing and conducting the removed moisture back to the orifice array 13. An optional cooler 50 may be positioned in the duct work 30 for cooling and, if desired, for condensing and removing a portion of the moisture content of the atmosphere in the duct work 30. A receptacle 56 may optionally be provided to receive condensate from cooler 50 and a duct 57 may be provided through which moistened air from the receptacle 56 can be blown by a fan 58 into duct section 36 to add additional moisture when necessary. Cooling of the atmosphere in the duct work 30 raises the relative humidity thereof as is well understood. Temperature and/or moisture content sensors may be provided at one or more locations in the duct work 30 and print zone 24 to control the heater and/or the cooler 50 and/or the fan 58 to provide atmosphere of desired moisture content and temperature to the print zone 24.

Preferably, the atmosphere near the print zone 24 is separated from the heat and air currents present in the moisture removal zone 25 by a separation wall 60. Optionally, a blower 70 may be positioned near the moisture removal zone 25 to assist in removing moisture from the printed media sheet by blowing air across the printed media sheet around and beneath the hood 32. Similar to the condensate receptacle 56 and fan 58 described above which optionally supplement the cooler 50, a pre-condenser 72 and moisture sensor controlled fan 74 may be provided to dry the atmosphere near the printed media sheet and, when necessary, to additionally humidify the atmosphere conducted back to the print zone 24.

Use of the drying and moisture re-circulation system of the printer 11 may best be appreciated in connection with high throughput inkjet printers which are capable of printing speeds of up to 200 sheets per minute or higher. Considerable moisture is generated in these inkjet printers and it is equally apparent that substantial amounts of moisture must be removed. To assist in doing so, opposed media pre-heater rollers 80, 82 or other means of heating the media sheets prior to inkjet printing are typically provided upstream of the print zone 24. Substantial amounts of water vapor generated by sheet drying may, depending on environmental conditions, not readily be absorbed into the surrounding air. High humidity and low temperature air generally reduces typical inkjet printhead problems such as clogged nozzles, dried ink on nozzle plates and the like. A high humidity, low temperature environment changes nozzle performance and improves print quality, so the illustrated embodiment collects, heats and cools moisture removed from printed sheets as necessary so that a suitably conditioned atmosphere may be conducted to the print zone 24 proximate to the orifice array 13 of the inkjet printhead (or printheads) 10, thus adding humid cool air to the inkjet printer side of the apparatus which has been removed from the moisture removal zone 25 downstream thereof. Improvement in print quality and life of the inkjet pens 10 reduces the pen servicing intervals and the associated down time of printing which is particularly important, especially in high throughput printers. Heat build up created by the heater 12 is easily controlled through use of the cooler 50 for adjusting the relative humidity and temperature of re-circulated moisture.

By way of illustrative example, but not limitation, a sheet printing speed of 30 inches per second resulting in a printing capacity of about 200 pages per minute may be assumed. The ink can be assumed to have a water content of about 80% and the moisture to be removed from a typical 8½ by 11 inch sheet of paper is calculated at about 0.86 grams per page. It can thus be seen that a considerable amount of moisture is generated in high speed printing but it is believed that the cost and operating expense of the equipment required to remove, condition and re-circulate the moisture is substantially offset by improvements in print quality and pen life. Keeping the printhead nozzles in a moist environment assists in preventing ink drying around the nozzles, yielding reduced printer down time for servicing such as wiping.

In conclusion, this disclosure illustrates examples of methods and apparatus in which moisture is removed from printed media having wet inkjet produced images by a heater and ducting which conducts the removed moisture from a moisture removal zone back to a print zone to maintain inkjet printheads having arrays comprised of one or more ink ejection orifices to improve printhead life and print quality. The quality of moist atmosphere removed from the printed media may be controlled by a cooler or condenser in duct work which conveys the moist air back to the printhead array to lower the temperature and elevate the relative humidity as desired. Optionally, the print zone may be separated from the moisture removal zone by a physical barrier and one or more optional blowers may be provided in the moisture removal zone to assist in removing moisture from the wet media.

Persons skilled in the art will also appreciate that various additional modifications can be made in the preferred embodiment shown and described above and that the scope of protection is limited only by the wording of the claims which follow.

What is claimed is:

1. A method of operating an inkjet printer comprising forming an image on media by ejecting ink from an orifice array of an inkjet printhead at a print zone, capturing moist atmosphere from said printed image at a moisture removal zone, adjusting relative humidity of said captured moist atmosphere and conducting at least part of said moist atmosphere to said orifice array.

2. A method according to claim 1, comprising heating said media at said moisture removal zone to assist in removing said moisture.

3. A method according to claim 1, wherein said relative humidity is adjusted by cooling said captured moist atmosphere.

4. A method according to claim 3, further comprising conducting a stream of atmosphere to said moisture removal zone to assist in removing said moisture from said media.

5. A method according to claim 4, further comprising moving said media from a print zone to said removal zone.

6. A method according to claim 5, further comprising preheating said media prior to forming said printed image thereon.

7. An inkjet printing mechanism which includes means for removing moisture from printed media, ducting for conducting at least part of said moisture removed from said printed media to an inkjet orifice array at a print zone and means for adjusting relative humidity of atmosphere in said ducting.

8. An inkjet printing mechanism according to claim 7, wherein said means for removing includes a heater positioned at a moisture removal zone spaced from said print zone.

9. An inkjet printing mechanism according to claim 8, wherein said ducting includes a hood proximate said heater for collecting said removed moisture.

10. An inkjet printing mechanism according to claim 9, wherein said heater includes means for convectively drying said media.

11. An inkjet printing mechanism according to claim 10, wherein said heater is an electrical resistance heater.

12. An inkjet printing mechanism according to claim 9, wherein said heater includes means for conductively drying said media.

13. An inkjet printing mechanism according to claim 12, wherein said heater comprises at least one heated roller.

14. An inkjet printing mechanism according to claim 7, wherein said means for adjusting comprises a cooler for increasing relative humidity of atmosphere in said ducting.

15. An inkjet printing mechanism according to claim 14, further comprising a blower for conducting air across printed media at said moisture removal zone.

16. An inkjet printing mechanism according to claim 7, further comprising a pre-heater for heating said media prior to inkjet printing at said print zone.

17. Apparatus for conditioning atmosphere at inkjet printhead orifices comprising: a heater for heating and removing moisture from printed media, ducting for re-circulating said moisture to inkjet printhead orifices at a print zone and a cooler for increasing relative humidity of atmosphere in said ducting.

18. An apparatus according to claim 17, wherein said heater is positioned at a moisture removal zone spaced from said print zone.

19. An apparatus according to claim 18, further comprising a blower for conducting air across printed media at said moisture removal zone.

20. An apparatus according to claim 19, wherein said ducting includes a hood proximate said heater for collecting said removed moisture.

21. An apparatus according to claim 20, wherein said heater is an electrical resistance heater.

22. An apparatus according to claim 20, wherein said heater comprises at least one heated roller.

23. An apparatus according to claim 22, further comprising a pre-heater for heating said media prior to inkjet printing at said print zone.

* * * * *